US005957200A

United States Patent [19]

Majek et al.

[11] Patent Number: 5,957,200

[45] Date of Patent: Sep. 28, 1999

[54] PLUNGER LIFT CONTROLLER

[75] Inventors: Alfred Majek, Stafford; Chris Fields, Houston, both of Tex.

[73] Assignee: Texas Electronics Resources, Inc., Houston, Tex.

[21] Appl. No.: 08/972,500

[22] Filed: Nov. 18, 1997

[51] Int. Cl.[6] ..... E21B 43/12; E21B 34/16

[52] U.S. Cl. ..... 166/250.15; 137/624.15; 166/53; 166/66; 166/372

[58] Field of Search ..... 166/53, 372, 250.15, 166/64, 66

[56] References Cited

U.S. PATENT DOCUMENTS

| | | | |
|---|---|---|---|
| 4,150,721 | 4/1979 | Norwood | 166/53 |
| 4,526,228 | 7/1985 | Wynn | 166/53 |
| 4,633,954 | 1/1987 | Dixon et al. | 166/372 |
| 4,916,617 | 4/1990 | Norwood | 166/53 X |
| 4,989,671 | 2/1991 | Lamp | 166/53 |
| 5,132,904 | 7/1992 | Lamp | 364/422 |
| 5,146,991 | 9/1992 | Rogers, Jr. | 166/369 |

*Primary Examiner*—Hoang C. Dang
*Attorney, Agent, or Firm*—David M. Ostfeld

[57] ABSTRACT

A microprocessor-based controller for oil or gas wells using a plunger lift device is disclosed, which responds to variations in the well production and operation through a series of pressure input signals derived from the well operation. The controller will automatically make corrections in the operation cycles to maximize the well performance and maintain environmental safety.

17 Claims, 7 Drawing Sheets

PLUNGER LIFT CONTROLLER

BACKGROUND OF THE INVENTION

1. Field of the Invention

The invention relates to the control of oil and gas wells using a plunger lift device and more particularly to adjustable control of such wells.

2. Background

Several technologies are used to assist the production of fluids from crude oil or natural gas wells. One of these involves the use of a plunger, a free moving rod or sealed tube with loose-fitting seals to prevent fluid bypassing between the plunger and the production tubing wall. The plunger is left at the bottom of the well until sufficient pressure has built up to allow the plunger to rise to the top of the well head, pushing the accumulated fluid ahead of the plunger. Movement of the plunger is normally controlled by opening a valve at the well head, connecting the tubing to an outlet line, such as the sales line or in some cases separation equipment used to separate oil, water, and gas. The principle of operation is based on the well slowly building up bottom hole pressure from fluids and gas passing from the formation into the well. When the sales valve is opened, the pressure in the sales line or separator is lower than the bottom hole pressure, so that the pressure differential causes the plunger to travel to the surface. In some instances it is desirable to leave the sales valve open for a period of time after the plunger has arrived at the surface. This time period is frequently referred to as "Afterflow." There are several conditions under which it is desirable not to operate the sales valve for safety or production efficiency reasons. For example, the sales line pressure might be so high that one would not want to try to force more fluid or gas into an already loaded system. Conversely, a low sales line pressure could suggest a broken or ruptured pipe.

History

The earliest devices which provided timing cycles for the sales valve were simple mechanical spring wound clock movements with pins or levers to open or close a pilot valve that would in turn operate a motor valve to operate the sales line. As technology advanced, these were superseded by battery-powered solid-state electronic timers such as the devices described in U.S. Pat. Nos. 4,150,721 and 3,445,746. These were then replaced by microprocessor-based units that could perform the same timing functions and also make limited changes in the time cycle based on outside influences. Such influences might include detecting the failure of the plunger to arrive in the expected time or observing high or low pressure limits through the use of external pressure switches such as the device described in U.S. Pat. No. 4,532,952. Further advances were made with the devices described in U.S. Pat. No. 5,146,991, which allowed production cycle changes based on the speed at which the plunger arrived at the well head.

SUMMARY OF THE PRESENT INVENTION

The present invention of a microprocessor based controller for oil or gas wells using a plunger lift device is addressed to an improved method for operating and controlling such an oil or gas well using the plunger system and procedures for assisted artificial lift of well fluids. Because of its flexibility and computational power, the modern microprocessor can perform a series of increasingly complex control algorithms as selected by the well operator. The controller can thus serve first as a manual control panel, performing operations on the oil or gas well only as directed by the human operator. The controller can serve as a simple low power timing device indicating elapsed times between various operations performed manually through the controller on the oil and gas well. The controller may also monitor the tubing and casing pressures in the oil and gas well. When the preset points are reached and other prescribed conditions are met, the controller instructs the sales line valve to open and begin the operator-defined process. This mode of operation eliminates the operator's assumptions about what changes may be occurring in the individual well or how the well may be affected by changes in the operation of another well producing from the same formation.

This microprocessor is preferably a battery-powered, solid-state electronic system with an associated set of program functions stored in nonvolatile memory connected by appropriate I/O to a well to permit improvement of the production efficiency of several different plunger lift applications. Additionally, the invention eases the human operator's burdens and improves safety of the equipment, environment, and personnel. Battery life may be extended with the addition of a photovoltaic panel, which may be mounted on top of the controller.

BRIEF DESCRIPTION OF THE DRAWINGS

For a better understanding of the nature and objects of the present invention, reference should be had to the following drawings in which like parts are given like reference numerals, and wherein.

DESCRIPTION OF THE PREFERRED EMBODIMENT OF THE PRESENT INVENTION

Figure 1:
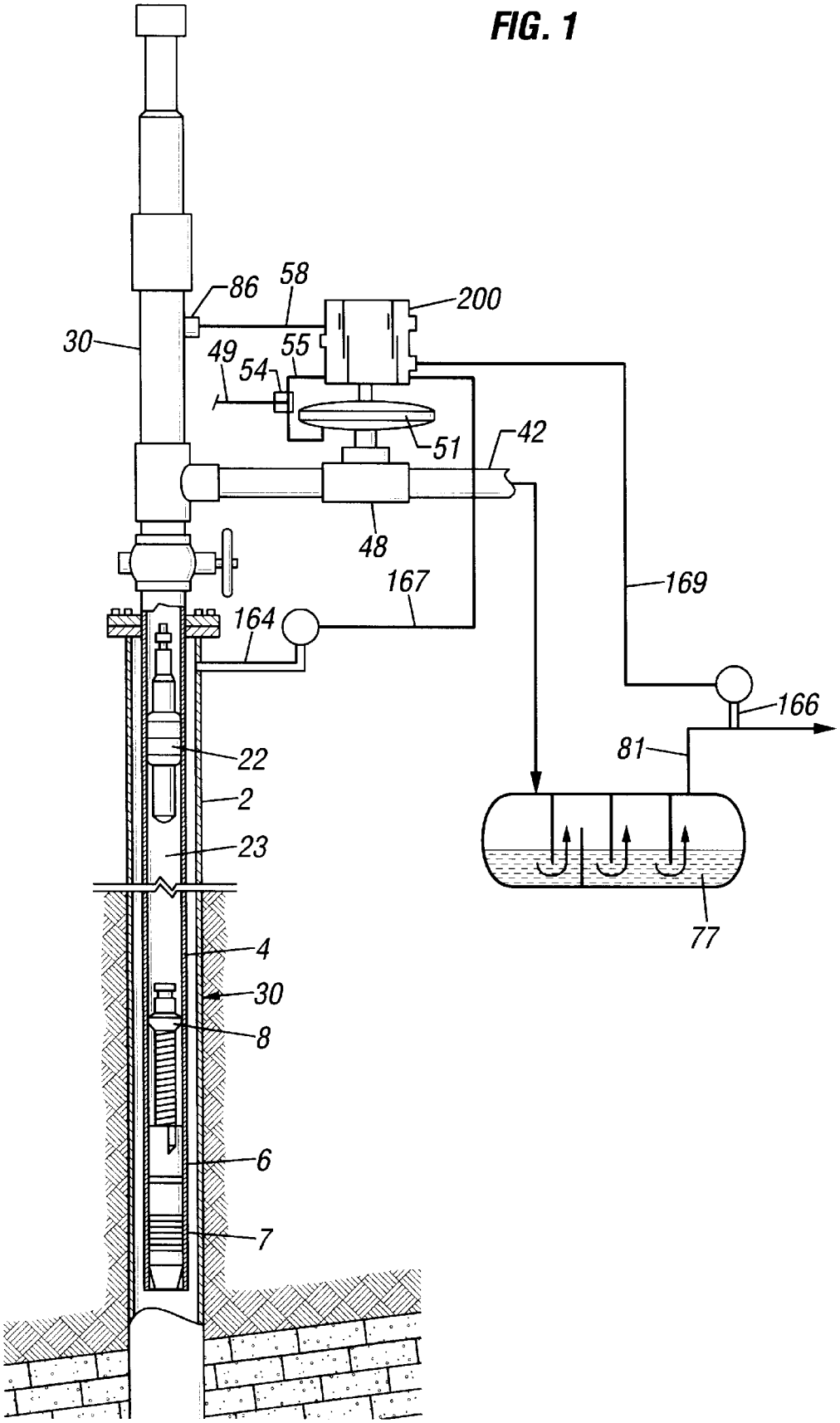
FIG. 1 is a sectional schematic of a typical well installation for use with the preferred embodiment of the present invention, such well installation including a separator but not a low pressure storage tank, the components of such well being shown sectionally and out of scale.
Figure 2:
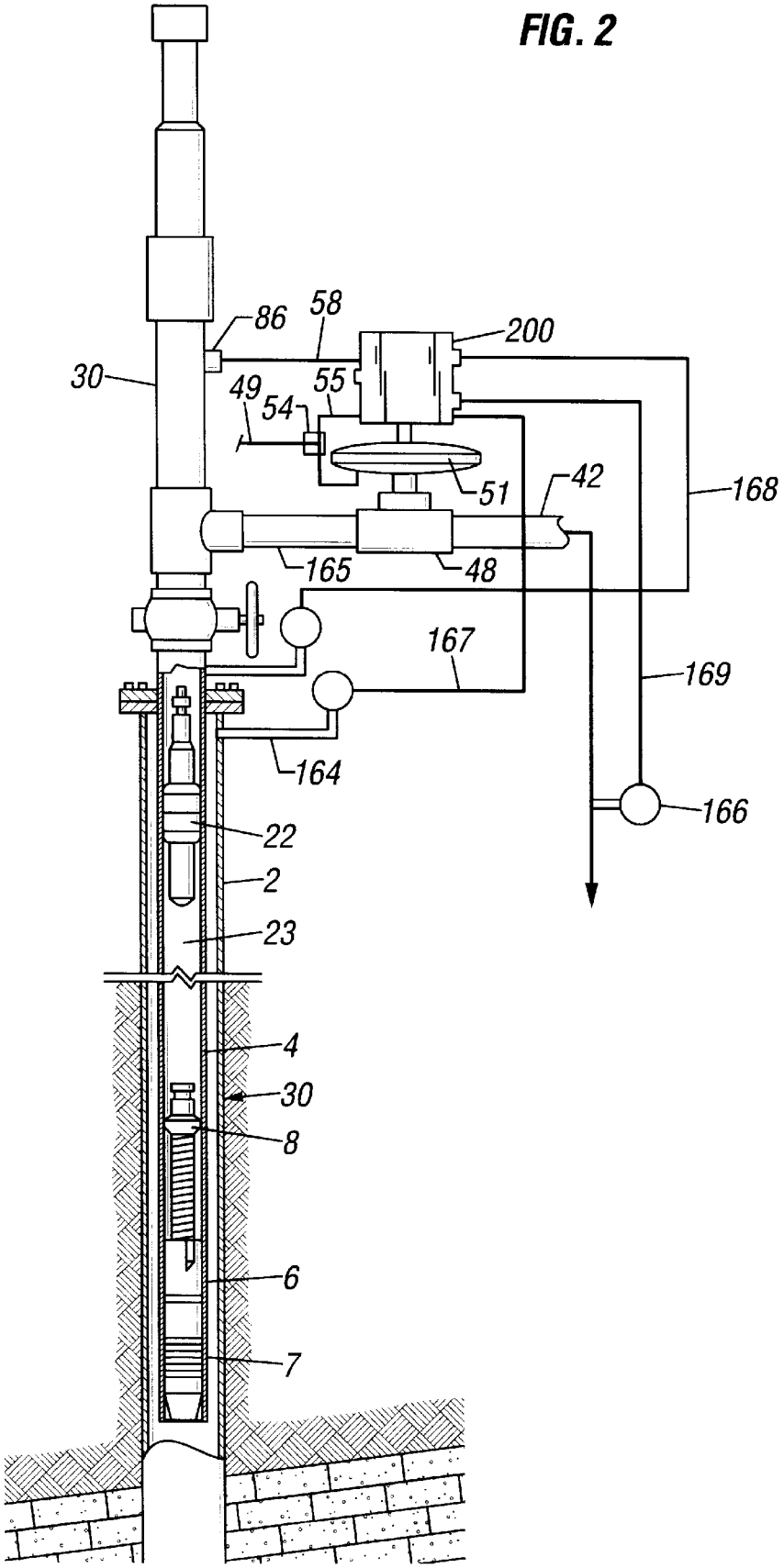
FIG. 2 is a sectional schematic of a typical well installation for use with the preferred embodiment of the present invention, such well installation including the well connected directly to the sales line, the components of such well shown sectionally and out of scale.
Figure 3:
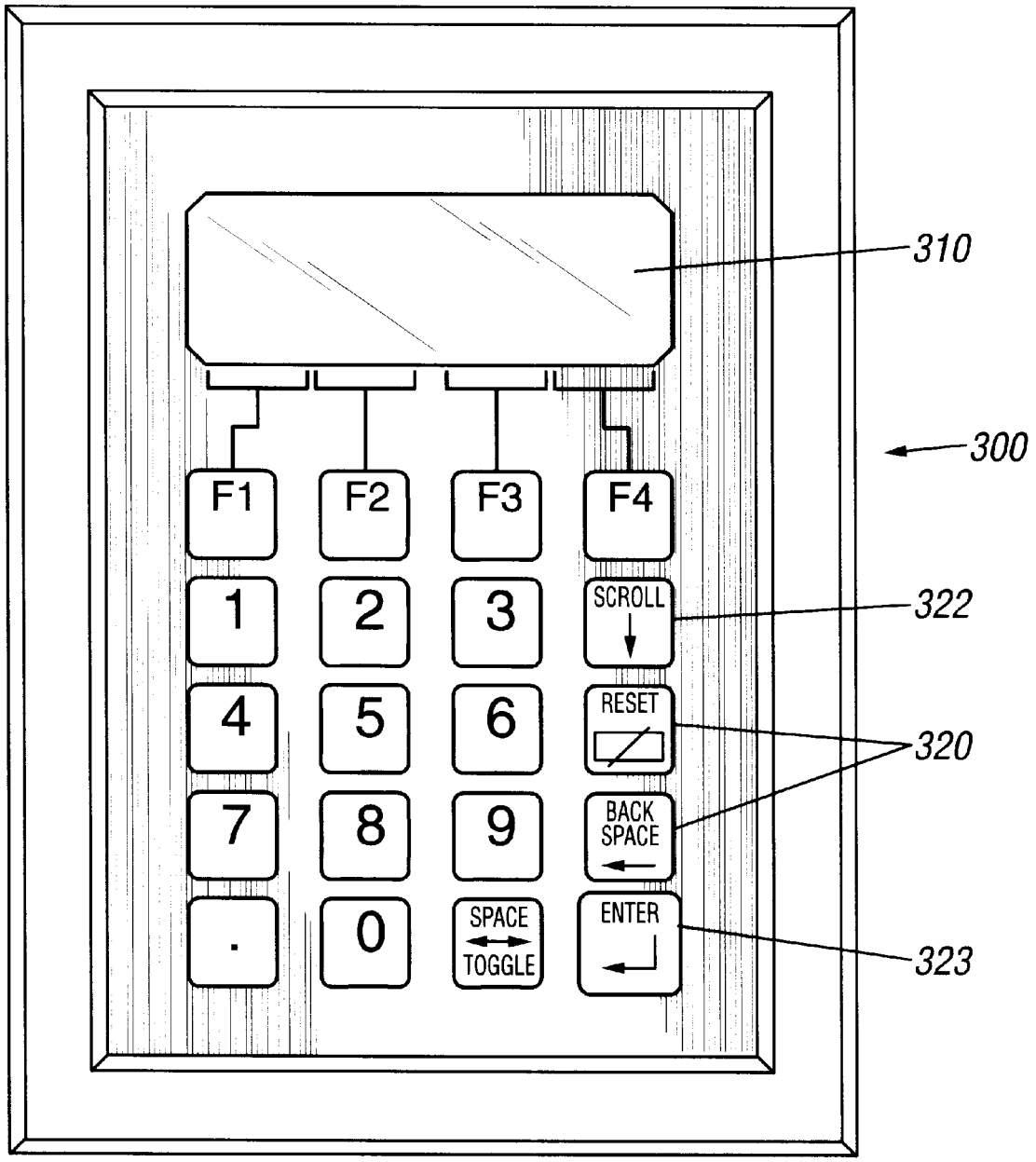
FIG. 3 is a pictorial representation of the front panel of the controller of the preferred embodiment of the present invention.
Figure 4A:
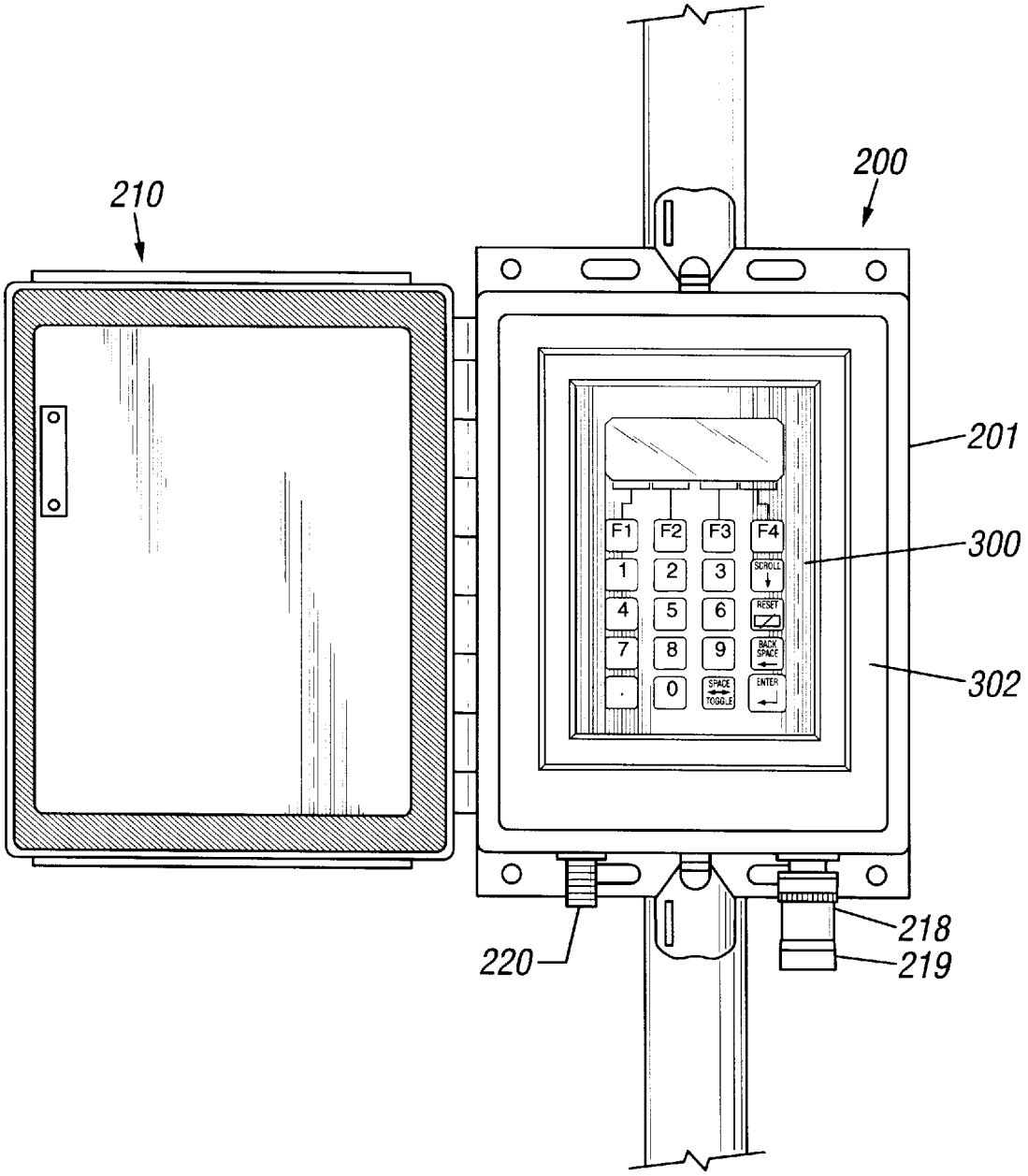
FIG. 4A is a front view pictorial of the preferred embodiment of the present invention.
Figure 4B:
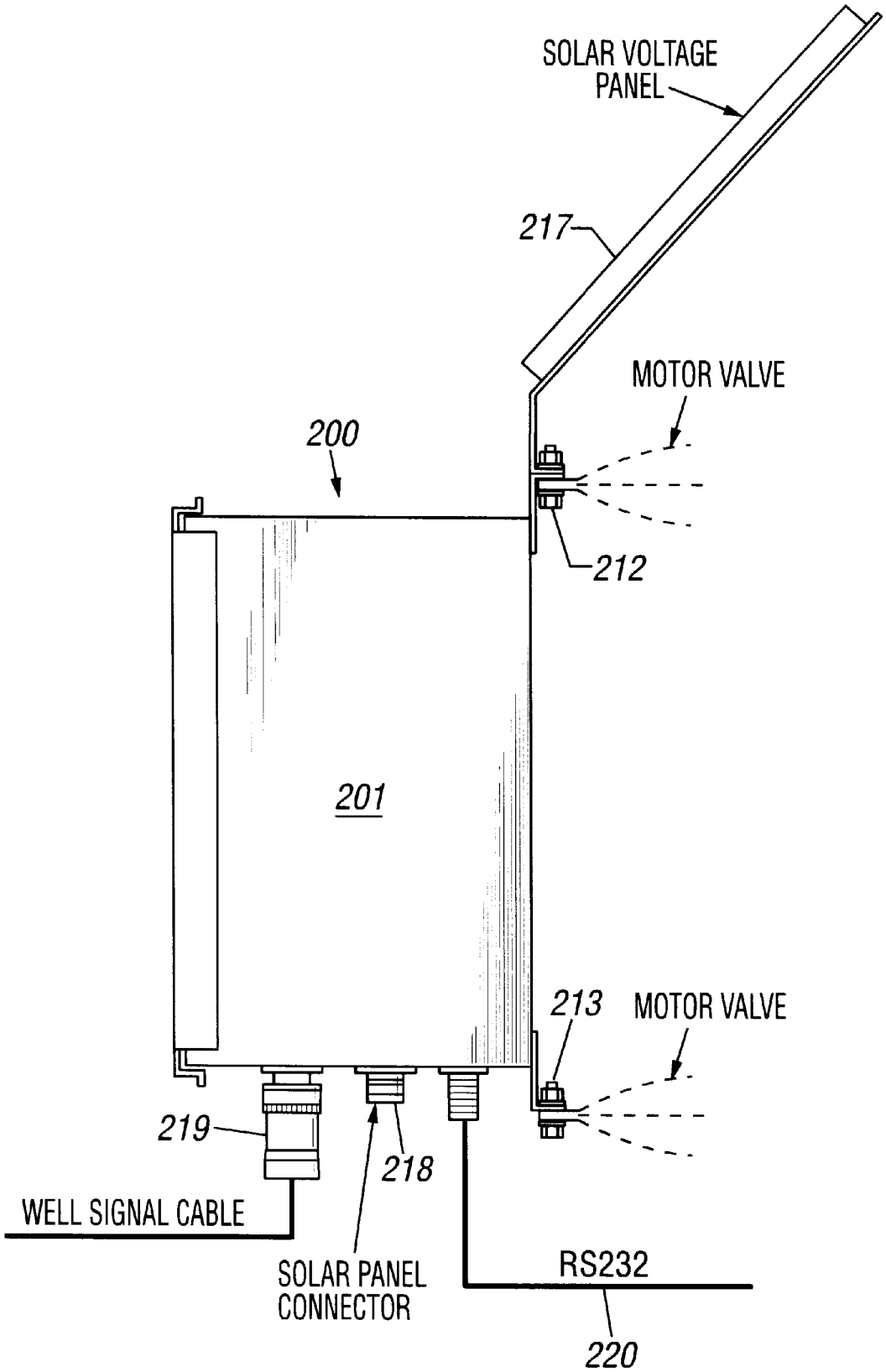
FIG. 4B is a side view pictorial of the preferred embodiment of the present invention including the solar power supply.
Figure 4C:
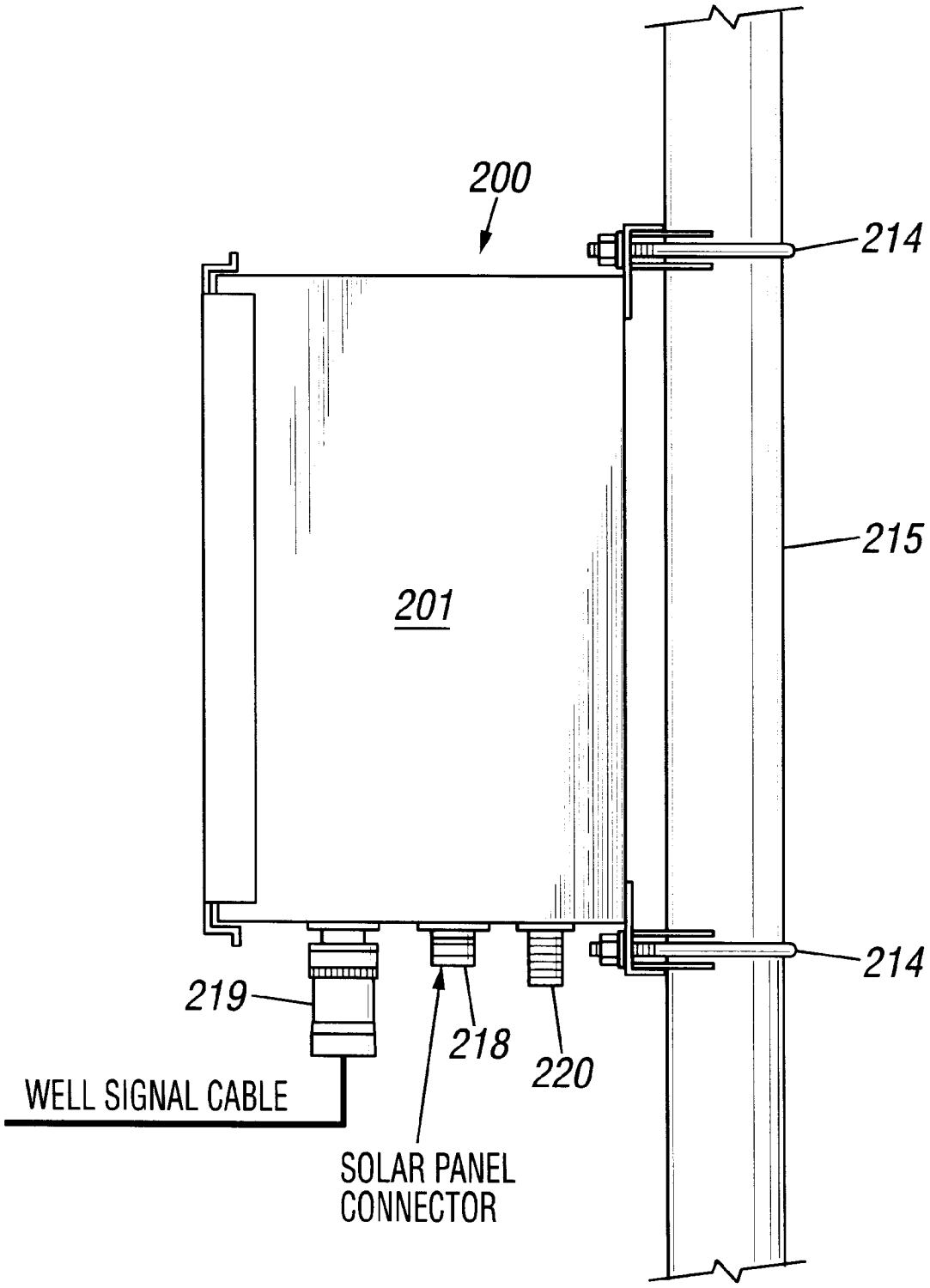
FIG. 4C is a side view pictorial of the preferred embodiment of the present invention.
Figure 5:
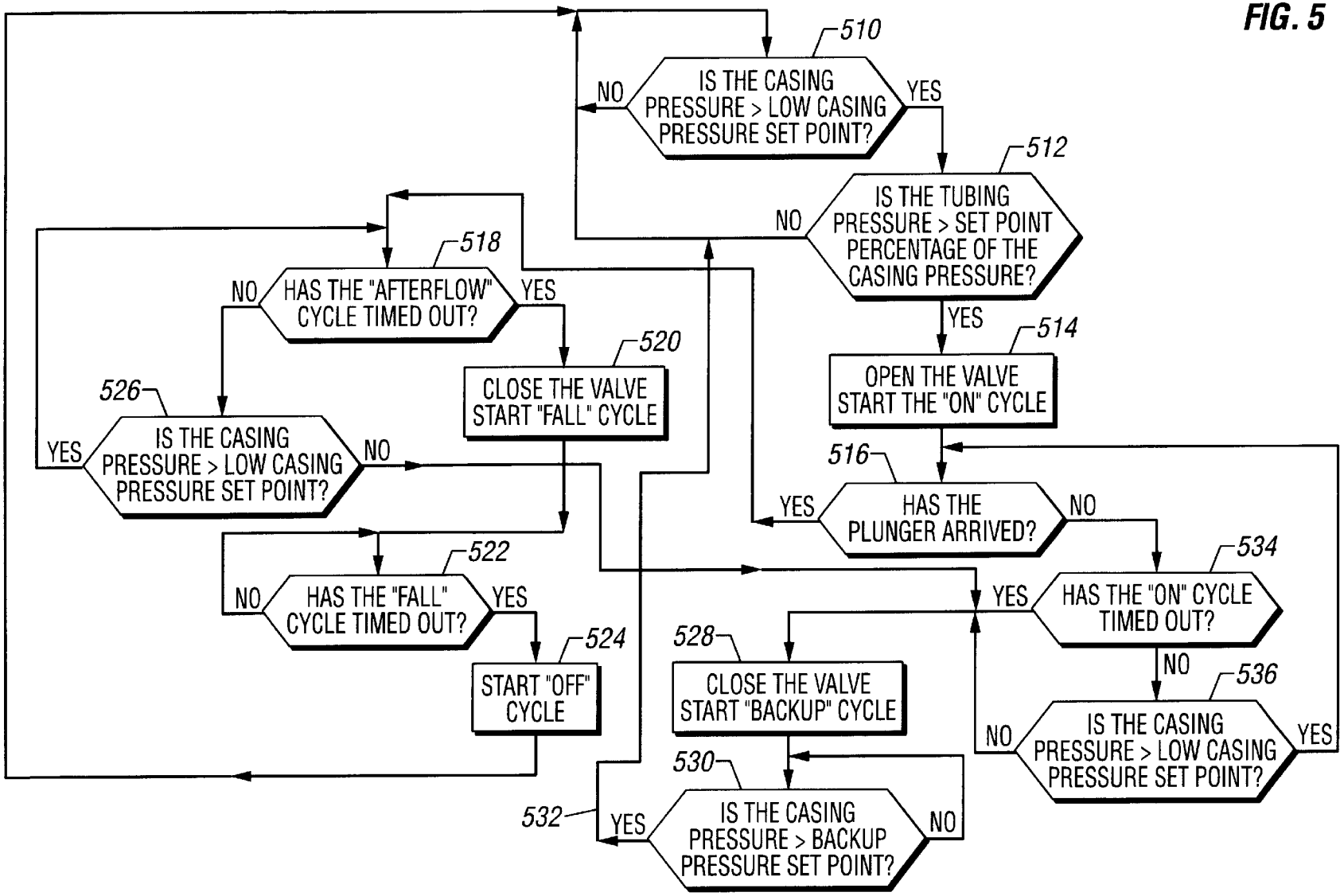
FIG. 5 is a two page logic flow diagram of the Pressure Control Mode of operation.

Referring to FIGS. 1–5, there is shown a well 30 having a production system for recovering oil or gas which includes production casing 6. At the lower end 7 of production casing 6 there is mounted a plunger receiver 8 which receives a plunger 22 thereon which rests on receiver 8.

Plunger 22 reciprocates within the interior 23 of production casing 6 between receiver 8 and a plunger detector 86 located at top of the well 30. The sales line 42 is also connected to the interior 23 of well 30, with the flow through sales line 42 governed by a valve 48. The actuation of valve 48 is through fluid flow line 49 connected to diaphragm 51 by solenoid valve 54. Further, as shown in FIG. 1 sales line 42 may be connected to a separator 77.

A controller 200 is electrically connected to detector 86 by line 58 and to solenoid 54 by line 55.

Controller 200 includes a well signal cable 219, such cable 219 containing the input and output connections discussed above. Controller 200 also includes an enclosure 201.

The controller 200 is self-contained and housed in enclosure 201 for use in the harshest remote outdoor sites. Controller 200 is microprocessor based, shown pictorially by indicator 302, to which is connected well signal cable 219. Cable 219 may include the above described signal lines 55, 58, 83 for well 30. Also mechanically mounted in controller 200 and connected to microprocessor 302 is a 20-button key pad 320 with a four line, 20 characters alphanumeric per line Liquid Crystal Display ("LCD") 310, all mounted as part of front panel, human interface 300. Typically, controller 200 will have provisions for four status inputs (switch contact closures), four analog input signals (voltage or current signals proportional to a variable, e.g. pressure) and a multiplexer, a communications port 220 meeting RS232 requirement, and outputs to control two latching solenoid valves, such various input and output to a microprocessor through an input and output module being well known in the art. The controller 200 also has a low power real time clock.

Thus, the controller 200 through the sensing of detector 86 by line 58 and control of the sales line valve 48 by line 55 will use the real time clock, store and display on command the last ten trip times (by subtracting from the time of the plunger arrival as detected by detector 86 from the time of opening of sales line valve 48 for each such trip), the total time spent with the sales valve closed (by subtracting the time of opening of sales line valve 48 from the last time sales line valve 48 was closed), the total time with the sales valve open (by subtracting the time the sales line valve 48 is closed from the last time the sales line valve 48 was opened), the number of plunger arrivals (by counting the number of times detector 86 senses arrival of plunger 8), and the number of failed arrivals (by using the real time clock to calculate the difference between the current time and the time of opening of the sales line valve 48 and comparing this difference to a preset value in the microprocessor so that when the difference exceeds such preset value without detector 86 having detected the arrival of plunger 8, a total is kept as well as individual instances being kept in the memory as a failed arrival. (It should be noted that each of the items would be kept and discarded on a circular file or integer size basis for each of the items described above.) The controller 200 also includes a 12 volt battery acting as its power supply.

Under normal operation, the controller 200 acts in a low power mode, during which it continues to monitor the inputs from well 30 but minimizes power consumption by disabling portions of the microprocessor and display panel. The controller 200 is activated when the door 210 is opened, or when any of the status inputs change state (e.g., the plunger 22 arrival as indicated by transducer 86 detecting of the plunger 22 or a high or low alarm limit switch closes, such as casing pressure switch or transducer 164 connected to controller 200 by line 167 or tubing pressure switch or transducer 165 connected to controller 200 by line 168 or discharge pressure switch or transducer 166 for sales line 42 connected to controller 200 by line 169), the communication port 220 detects the presence of a carrier signal, or the low power real time clock signals the completion of the current timing interval.

For abnormal operation, the LCD 310 flashes a warning every three seconds when the battery (not shown) is low. Other alarm conditions are displayed on the status screen LCD 310.

Access to the stored data via the data entry or key pad 320 can be operationally controlled by a password code as is well known in the art. Without a password code programmed, any of the parameters can be modified in the controller 200. If a password has been programmed, four levels of access are available. The first level does not require the password and allows the user only to view the different system parameters which are as described more particularly below and the maximum time failed arrival interval described above, and historical data. If the password option for the controller 200 were used, the password must be entered to modify data or settings, as is well known in the art. If the password is entered correctly, the second level of security is enabled and all parameters and data may be modified or cleared. A third level of security may also be used for field supervisor access. This password would preferably be entered at the factory and would not be alterable in the field. This level of password would normally be used in case the field programmed password is lost or forgotten. Preferably, there is also a factory access level for diagnostics and testing.

The controller 200 is preferably enclosed in an 8"×10"×6" stainless steel enclosure 201 with a hinged front door 210 that is latching and lockable. The front panel 300 is weatherproof and acts as the seal protecting the electronics inside the enclosure 201, even if the front cover 210 is left open. Electrical access is provided via three weatherproof electrical connectors 218, 219, 220 mounted on the bottom of the enclosure 201. The controller 200 may be mounted above or below the motor valve 48 using the mounting brackets 212, 213 that are part of the enclosure 201. The enclosure 201 may be mounted to a pipe or post 215 using U-bolts 214. A solar voltaic panel 217 may be connected to the internal electronics via the two-pin connector 218 on the under side of the enclosure 201. The mounting location of the solar panel 217 is left to the discretion of the installer, though it is frequently mounted on top of the enclosure 201.

Electrical signals to and from the well 30 enter the enclosure 201 via the Well Signal cable connector 219. The latching electrically operated solenoid valve(s) 54 is powered by 12 volt DC pulses ordering them to open or close, as is well known in the art. The solenoid valve 54 is typically provided by the installer and are mounted external to the enclosure 201 and are connected to the controller 200 by field installed wiring via the well signal cable connector 219. The control solenoids provide gas or air to operate the motor valves 48.

All time intervals, alarm limits and operation mode commands are entered or changed through the use of the key pad 320 and LCD 310. After entering the password (if one was programmed or used), the operator uses the scroll key 322 to reach the screen displaying the parameter to be set or changed, enters the new setting via the numeric key pad 320 and presses enter 323.

Operation Modes

Manual Mode: In manual mode, all functions are carried out by commands entered from the control panel 300. The display 310 flashes "Manual Mode" every three seconds to inform the user that the controller will not automatically control the well 30. In the manual mode all alarm signals are preferably ignored except the low battery condition. The manual mode would most frequently be used to take the well 30 out of production for extended periods of time.

Auto Mode: The device acts as an electronic timer. The operator enters On time, Off time, and Backup time. During the On time cycle, the sales valve 48 is held open, allowing fluid and gas to pass to the sales line 42. The controller 200 continues to alternate between the On and Off cycles unless the plunger 22 does not arrive during an On time. In this case of the failure for the plunger 22 to arrive, the controller 200 switches to a Backup time cycle. This additional Backup time cycle is generally longer than Off time and allows the well 30 to build up enough pressure to ensure a plunger 22 arrival on the next On time cycle. Backup time will replace the Off time when a plunger 22 arrival is not detected. The Backup time cycle will also be activated if low pressure in the casing is detected by the casing pressure switch or transducer 164, during an On, Afterflow, or Tank cycle. If the low pressure on the casing is detected by the transducer 164, controller 200 compares the value of the transducer with a preset value or set point stored in the controller 200. If high pressure is detected by the casing pressure switch or transducer 164 during an Off or Backup Cycle an On cycle will begin. If the high pressure is detected by the transducer 164, controller 200 compares the value of the transducer 164 with a preset value or set point stored in the controller 200. If, during a cycle where the sales valve 48 is open, the discharge pressure switch or transducer 166 detects a high pressure condition both valves will close and not reopen until the condition connection is corrected. If the high pressure condition is detected by the transducer 166, controller 200 compares the value of the transducer 166 with a preset value or set point stored in the controller 200. Additional timing states or cycles may be incorporated in the standard product base program library of controller 200 and may be optionally added to the basic Auto Mode operation. These optional cycles are:

(1) Afterflow cycle, during which the sales valve 48 is kept open after the plunger 22 has arrived. If the Afterflow cycle is used, a plunger 22 arrival during the On cycle causes the controller 200 to switch to Afterflow. The fluid flow is sufficient to keep the plunger 22 held in the lubricator part of well 30 at the top of the well 30 and out of the path to the sales line 42. At the end of the cycle, the sales valve 48 is closed and the controller 200 enters the Off cycle.

(2) Fall time, during which a high pressure detected by a pressure switch or by the casing pressure transducer 164 is ignored while the plunger falls back to the bottom of the well 30.

Analog Pressure Control Mode: In this mode, the controller makes use of its computing and decision making ability. The maximum production of a particular well is determined by the fluid and gas producing ability of the geological formation from which the well draws. Additionally, the gas and fluid flow into the well bore vary with time and changes in overall formation, sales line back-pressure and other variables. The primary purpose of a plunger lift system is to remove or produce the fluid when sufficient pressure has built up in the bottom of the well to assure that the plunger will arrive at the well head and complete its cycle. The addition of two analog pressure switches or transducers, a casing pressure switch or transducer 164 for measuring casing pressure and a tubing pressure switch or transducer 165 for measuring tubing pressure, provides the information necessary to allow the controller 200 to make changes to improve production efficiency. The analog pressure switches are detected either digitally or by reading the electrical value of the transducer and converting it to a digital value through an analog-to-digital converter. In this situation, the operator enters the following information: On time, Off time, Backup time, Afterflow time, Fall time (optional), Backup pressure set point, casing pressure set point, and tubing pressure set point as a percent of casing pressure. Sales line pressure may also be scanned. If sales line pressure is used, the operator must also enter the upper and lower sales line pressure limits. The sales line pressure data is provided by a discharge pressure switch or preferably a transducer 166 on the sales line 42.

In practice, the controller 200 starts the cycle with the plunger 22 at the bottom of the well 30. When the casing and tubing pressures reach their respective set points, the controller 200 switches to the On cycle and opens the sales valve 48. When the plunger 22 arrives at the top of the well 30, the On cycle is terminated. The sales valve 48 is then closed and the plunger 22 falls back down the well 30. If the user has entered a Fall time, the casing and tubing pressure set points are ignored for the duration of the Fall cycle. The controller 200 then goes into the Off mode and begins monitoring the casing and tubing pressures.

If during the On or Afterflow cycle the casing pressure falls below the set point, the controller 200 ends the current cycle, closes the sales line valve 48, allows the plunger 22 to drift back down the well 30, and initiates the Backup cycle. In order for the Backup cycle to end, the casing pressure must exceed the Backup set point and the tubing pressure must reach the required fraction of the casing pressure. If these conditions are met, the controller 200 enters the On cycle.

If during the On cycle the plunger 22 does not arrive before the On cycle has timed out, the controller 200 will enter the Backup mode, and close the sales line valve 48. If the pressure in the sales line 42 is outside the user-defined limits an alarm condition is created and the controller 200 will revert to and remain in the Off cycle until the alarm condition is corrected.

The analog inputs of the controller 200 are designed for voltages greater than one volt and less than five volts and connect to a multiplexer and analog-to-digital converter as an input to controller 200. These analog inputs may be provided by a 4 to 20 mA transmitter if the appropriate 250 U resistor is placed across the input terminals. The controller 200 declares a signal invalid when the input signal voltage is less than one volt and greater than five volts. If the controller 200 detects an invalid signal from the casing or tubing pressure switches or transducers 164, 165, an alarm condition is created and the controller 200 will revert to the timed control cycles as defined above in the Auto Mode. The controller 200 will indicate the appropriate alarm condition on the status display.

Because many varying and different embodiments may be made within the scope of the invention concept taught herein which may involve many modifications in the embodiments herein detailed in accordance with the descriptive requirements of the law, it is to be understood that the details herein are to be interpreted as illustrative and not in a limiting sense.

What is claimed:

1. A controller to control production of a well using tubing positioned in a casing and a plunger in the tubing and a plunger detector near the surface of the well and a valve between the tubing and an outlet line, comprising:

a microprocessor having an output connected to the valve to open and close the valve, a first pressure sensing means for sensing pressure in the tubing and a second pressure sensing means for sensing pressure in the casing and an input connected to the plunger detector;

said microprocessor having an entry means for setting a first pressure value for said first pressure sensing means and a second pressure value for said second pressure sensing means; and said microprocessor having a test means for sensing said first pressure sensing means reaching said first pressure value and said second pressure sensing means reaching said second pressure value and then opening the valve.

2. The controller of claim 1, wherein said microprocessor has a first close means for closing the valve responsive to the plunger detector signaling the presence of the plunger.

3. The controller of claim 2, wherein said first close means maintains the valve open for a period of time after the plunger is detected.

4. The controller of claim 2, wherein said first close means maintains the valve open for a period of time after the plunger is detected, said time for maintaining the valve open being a function of pressure detected by the second pressure sensing means.

5. The controller of claim 1, wherein said entry means sets a third pressure value.

6. The controller of claim 1, wherein there is further included a display, said microprocessor having outlets connected to said display.

7. The controller of claim 1, wherein said entry means includes a human interface, said human interface connected to said microprocessor and having first means for displaying said first pressure value and said second pressure value.

8. The controller of claim 7, wherein said human interface includes second means for initiating manual operation of said controller.

9. The controller of claim 8, wherein said second means includes third means for indicating to said microprocessor to open the valve.

10. The controller of claim 9, wherein said third means includes a means for indicating to said microprocessor to close the valve.

11. The controller of claim 1, wherein there is further included a communication port having means for reporting to a remote location the status of the well.

12. The controller of claim 1, wherein there is further included a housing and said entry means includes a human interface, said housing having a door covering said human interface and having two states, open and closed, said state of said door being open being an input to said microprocessor, said microprocessor means activating said human interface when said door is open.

13. The controller of claim 12, wherein said microprocessor further includes a power supply and a detector for the power supply being low, said microprocessor having an input connected to the state of said low detector of said power supply, said microprocessor means activating said human interface to display the status of low power supply.

14. The controller of claim 1, wherein the well includes a pressure transducer and said microprocessor includes an alarm means for detecting a pressure greater than a preset value, and wherein said alarm means suppresses detection of the pressure transducer indicating said greater value during the time the plunger falls back to the bottom of the well.

15. A method of controlling production of a well having tubing positioned in a casing and a plunger in the tubing and a plunger detector near the surface of the well and a valve between the tubing and an outlet line, comprising the steps of:

detecting the event of a first pressure reaching a first pressure value in the casing and a second pressure reaching a second pressure value in the tubing;

opening the valve upon the event;

detecting the presence of the plunger using the plunger detector;

closing the valve; and monitoring said tubing and said casing for said first pressure to reach said first pressure value and said second pressure to reach said second pressure value.

16. The method of claim 15, further including the step of maintaining the valve open for a period of time after the plunger is detected.

17. The method of claim 16, further including the step of monitoring a third pressure and closing the valve in response to a pressure that is greater than a preset limit for said third pressure.

* * * * *